United States Patent [19]

Myers

[11] Patent Number: 4,486,988

[45] Date of Patent: Dec. 11, 1984

[54] MULTI-PURPOSE ELEVATED WATER STORAGE FACILITY

[75] Inventor: Clarence H. Myers, Birmingham, Ala.

[73] Assignee: Pittsburgh-Des Moines Corporation, Pittsburgh, Pa.

[21] Appl. No.: 423,253

[22] Filed: Sep. 24, 1982

[51] Int. Cl.[3] ..... E04H 7/00

[52] U.S. Cl. ..... 52/192; 52/247; 220/1 B

[58] Field of Search ..... 52/194, 245, 247, 248, 52/741, 192; D23/2; 220/1 B

[56] References Cited

U.S. PATENT DOCUMENTS

| | | | |
|---|---|---|---|
| D. 265,226 | 6/1982 | Carlat et al. | D23/2 |
| 1,971,342 | 8/1934 | Goldsby | 52/194 X |
| 2,657,819 | 11/1953 | Blackburn | 220/1 B |
| 2,690,273 | 9/1954 | Arne | 220/1 B |
| 3,073,018 | 1/1963 | Gauthron | 220/1 B X |
| 4,181,237 | 1/1980 | Kenyon et al. | 220/1 B X |
| 4,313,457 | 2/1982 | Cliff | 220/219 X |
| 4,327,531 | 5/1982 | Cazaly et al. | 52/194 X |

OTHER PUBLICATIONS

*Hydro Pillar*, Sales brochure, Bulletin 103 Pittsburgh-Des Moines Steel Co., Copyright 4/1971.

*Primary Examiner*—Carl D. Friedman

*Attorney, Agent, or Firm*—Shoemaker and Mattare, Ltd.

[57] ABSTRACT

A multi-purpose elevated water storage facility includes a water tank which has a fluted portion. The pillar supporting the tank can also be fluted. A box girder can be used to connect the tank fluted portion to the pillar and to a bottom portion of the tank, and additional usable space can be defined above a water storage portion of the tank.

20 Claims, 7 Drawing Figures

MULTI-PURPOSE ELEVATED WATER STORAGE FACILITY

BACKGROUND OF THE INVENTION

The present invention relates in general to elevated water storage facilities, and, more particularly, to multi-use elevated water storage facilities.

Elevated water storage facilities encompass vast areas of usable space. To make maximum use of such space, the assignee of the present invention manufactures such facilities which include means for dividing the space beneath the elevated tank into a plurality of floors. An example of such facilities is disclosed in U.S. patent application Ser. No. 168,808, filed on July 11, 1980. The disclosure of such patent application is incorporated herein by reference thereto.

As use of such multi-purpose structures increases, more aesthetically pleasing structures are required.

Furthermore, the water tanks of these facilities are often constructed using a multiplicity of smooth plates, and during construction, these plates can become deformed. Any deformed plates can detract from the aesthetic appeal of the facility, especially if light paint is used on the facility. The deformation is often due to the difficulty of getting the top of the outer cone portion of a tank into a true plane. In addition, a large diameter tank of thin shell plates tends to yield flat spots at the vertical weld seams, and at times buckles show up in varying degrees. This is especially true when it is necessary to re-weld any of the seams. To get an elevated water storage facility erected with a satisfactory smooth shell demands more time and effort and additional fitting devices, such as temporary rolled stiffener angles, than other portions of the tank.

Thus, there is need for an elevated water storage facility which can be erected in an expeditious manner and will remain aesthetically pleasing.

SUMMARY OF THE INVENTION

The multi-purpose elevated water storage facility of the present invention includes a pillar supporting an elevated water storage tank which has a flute portion, thereby rendering the overall facility more efficient and aesthetically pleasing.

The fluted portion of the tank includes a plurality of fluted plates, and is coupled to the pillar by a box girder in the preferred embodiment.

Additional stiffening rings are also included, and an additional floor can be included above the water stored in the tank.

The major advantages of the fluted shell water tank during erection are as follows:

1. Sub-assemblies of the fluted shell can be completed on the ground simultaneously with other operations being concluded in the air.
2. The erection and welding of the shell in the air can be done without scaffold by using proper erection devices.
3. The fluted shell is stiff enough to allow the outer cone bottom of the tank to be fit to it resulting in a planar and easily welded horizontal joint.
4. Using present smooth shell designs, the tank shell must be erected and the welding of the top angle completed before the roof can be erected. With the fluted shell, after the flutes are erected and as the welding of its bottom seam and vertical shell seams are being done, roof erection can begin immediately, thereby allowing parallel activities on the roof and fluted shell.
5. The fluted shell resists blow-in.

OBJECTS OF THE INVENTION

It is, therefore, an object of the present invention to make a multi-purpose elevated water storage facility easier to erect and more aesthetically pleasing.

This together with other objects and advantages which will become subsequently apparent resides in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
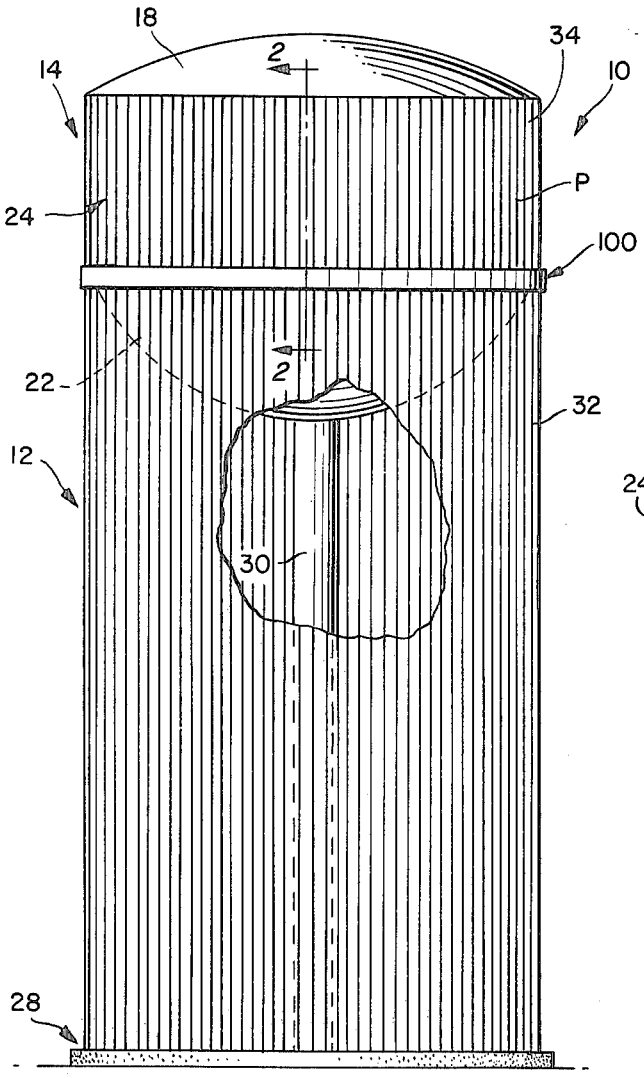
FIG. 1 is an elevation view showing an elevated water storage facility embodying the teachings of the present invention.
Figure 5:
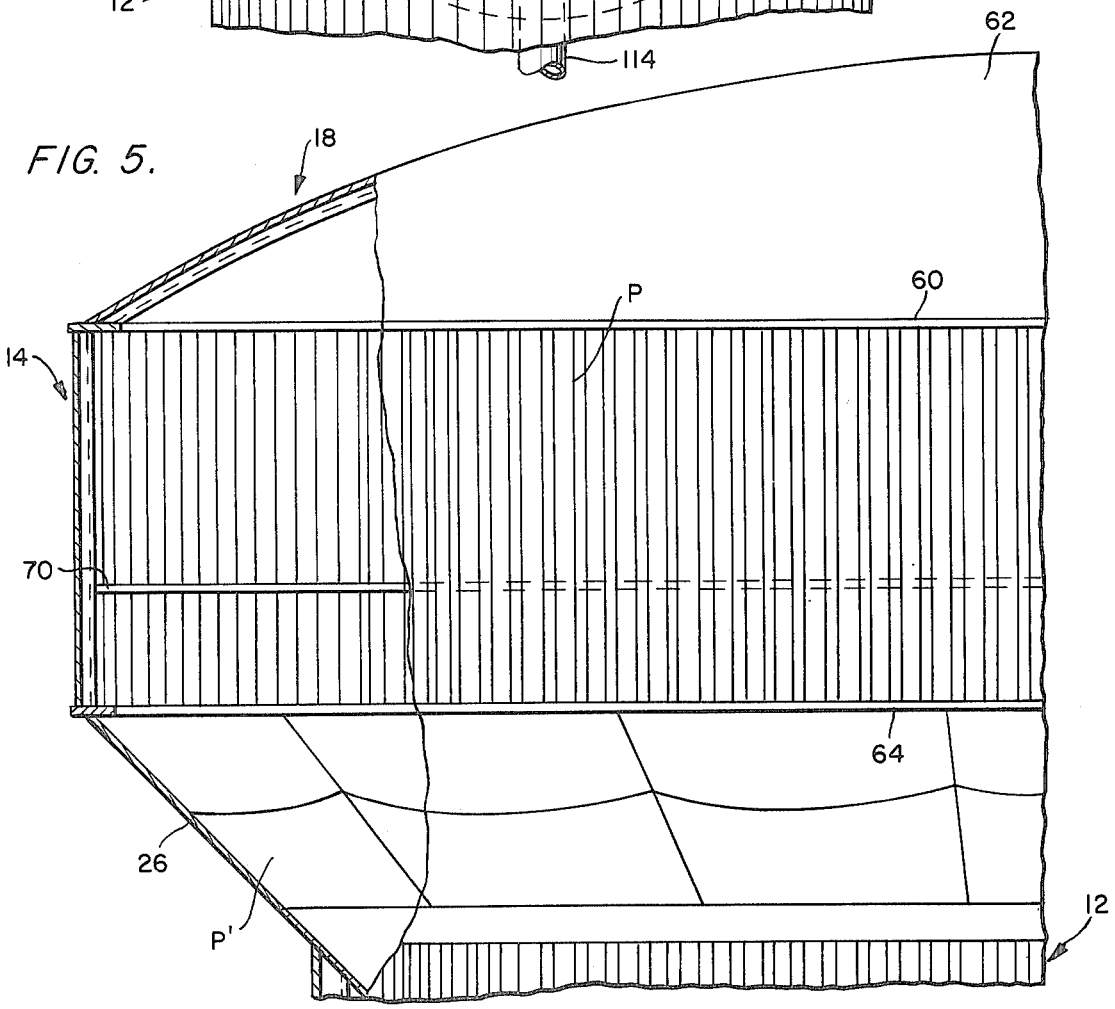
FIG. 5 is an elevation view of an alternative embodiment of an elevated water storage facility embodying the teachings of the present invention.

Shown in FIG. 1 is an elevated water storage facility 10 which includes a pillar 12 and a tank 14 supported thereon. The tank occupies substantially all of the top cross-sectional area of the pillar, and includes an arcuate roof 18, a spherical bottom 22 and a cylindrical portion 24. The spherical portion 22 is located inside the pillar, and, in some embodiments, a conical portion 26 rests on the pillar, as best shown in FIG. 5. The roof can be dome-shaped, if suitable. The facility is supported on a base structure 28 and includes a riser 30, and other means for conducting water to users, some of whom may be located at great distances from the facility.

The pillar is fluted, as at 32, as in the tank cylindrical portion, as at 34. The pillar has an outer diameter substantially equal to the outer diameter of the cylindrical portion, preferably within 2 feet of that outer diameter.

Figure 7:
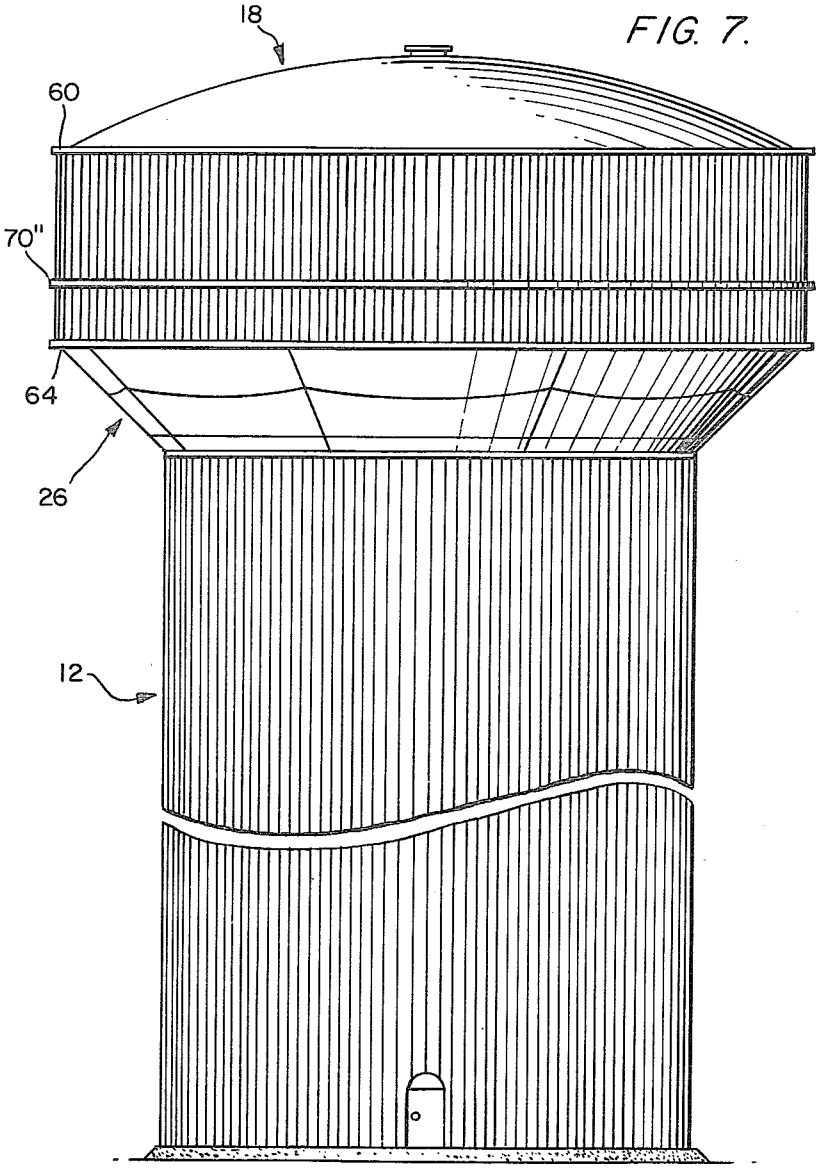
FIG. 7 is an elevation view of an elevated water storage facility having a shell tension ring on the outside of the tank shell in the form of a flat ring.
Figure 6:
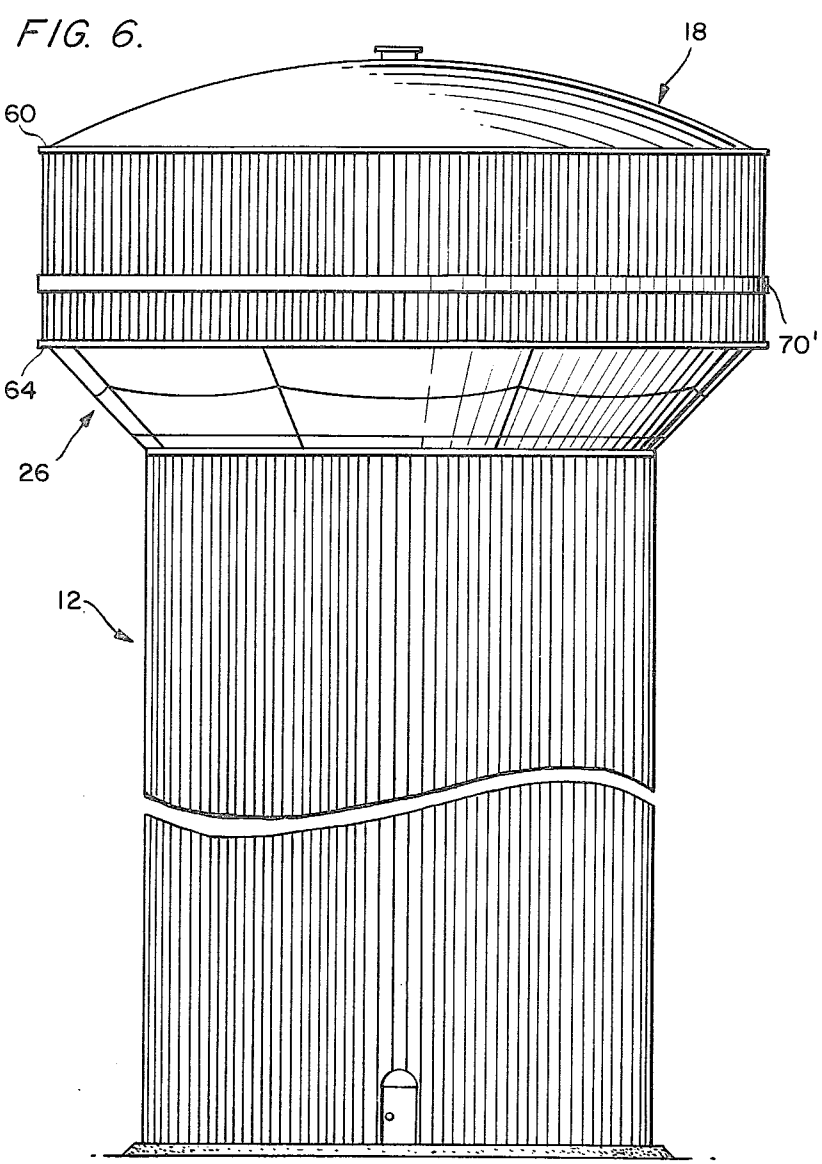
FIG. 6 is an elevation view showing a water storage facility having a shell tension ring on the outside of the tank shell in the form of a cylindrical band.

The present disclosure is concerned with the tank cylindrical portion 24. Preferably, this portion 24 includes one or more rings, each formed of a plurality of plates P. Any conical portion includes a plurality of plates P′ as well. As shown in FIG. 5, in the case of a dome roof, the cylindrical portion can include ninety-six flute cycles with forty-eight plates. At the upper end of such plates, a ring 60 connects the plates to dome 62. At the lower end of the plates, a shell cone ring 64 connects the plates to the conical portion 26 of the tank. These rings, plus a third ring 70, resist the loads which are induced by the water pressure of water stored in the tank. Third ring 70 can be located anywhere between the rings 60 and 64, but is preferably located at one-third of the tank height and either interior or exterior of the tank. The three rings 60, 64 and 70 work in concert to provide strength to the tank. Water pressure is then carried by bending of the flutes in the vertical direction which transfers the load to these three rings. The third ring 70 is shown on the inside of the tank of FIG. 5, and on the outside of the tank in FIGS. 6 and 7, with FIG. 6 showing the ring 70' in the form of a cylindrical band, and FIG. 7 showing the ring 70'' in the form of a flat ring.

As discussed above, in forming such tank, welding, plate warping, or the like may create anomalies in non-fluted cylindrical plates used to construct the tank portion and affect the appearance of the tank. By using fluted plates, this difficulty is overcome.

Erection of the facility 10, which includes a tank having one ring of fluted plates in the cylindrical portion thereof, includes steps of erecting the fluted pillar 12, and erecting the cone portion 26, while simultaneously making ground subassemblies of the fluted plates of the cylindrical portion 24. Two to four of the fluted plates are fit together and welded on the ground and a portion of the ring 64 is welded to their lower end to form a subassembly. When all subassemblies are complete, they are lifted into position at the upper end of cone portion 26. The joints between the subassemblies are fit together and tack welded. Then the joint between the cone portion 26 and the ring 64 is fit and tacked. Next, ring 70 and ring 60 are fit together and to the fluted plates 14. While the various joints in this portion of the tank are being welded, the roof erection is commenced.

The above-discussed procedure can be adapted to other facilities as well, and no limitation to the one ring of flute plates, or the three strengthening rings 60, 64 and/or 70 or the like is intended.

It is noted that during roof erection, the vertical welds between the fluted plates can be fit and welded. Thus, a parallel operation between the fit up and welding of the vertical seams and fluted tank shell and the welding of the roof can occur. A reduction in overall erection time results.

Figure 3:
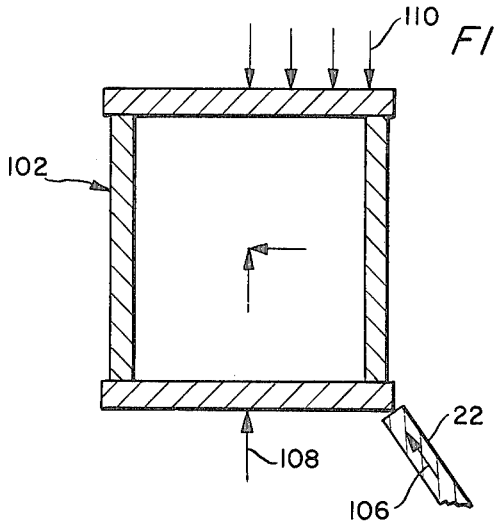
FIG. 3 is an elevation view taken along line 3—3 of FIG. 2.

Best shown in FIG. 1 is a coupling means 100 for coupling the tank 14 to the pillar 12 when the tank and the pillar have the same outer diameter. Means 100 includes a box girder 102. The coupling means 100 couples the tank cylindrical portion to the spherical bottom and to the pillar. This intersection is also shown in FIG. 3 along with loading vectors 106, 108 and 110.

Figure 2:
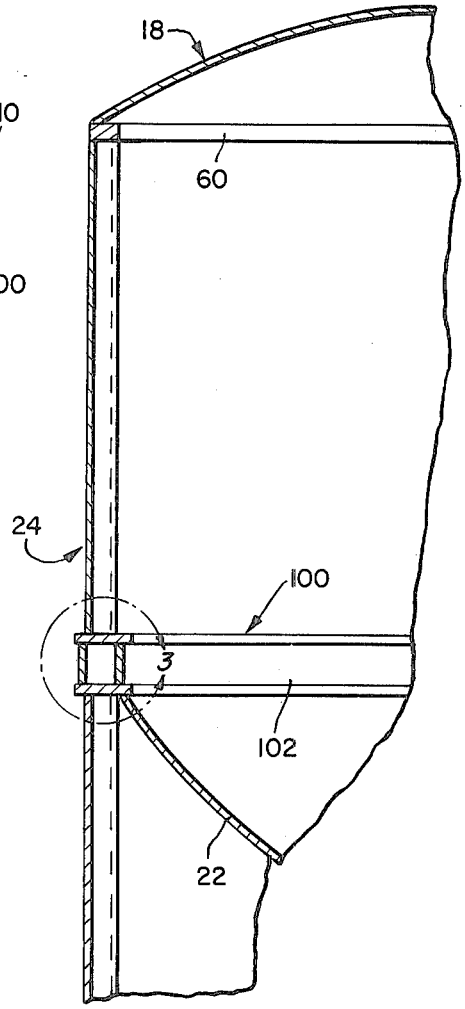
FIG. 2 is an elevation view taken along line 2—2 of FIG. 1.

The FIG. 2 embodiment utilizes the above-discussed three strengthening ring concept wherein the lowermost strengthening ring 64 is replaced by the box girder 102, and a box girder can also be used in the frame of any flooring included in the elevated water storage facility.

Figure 4:
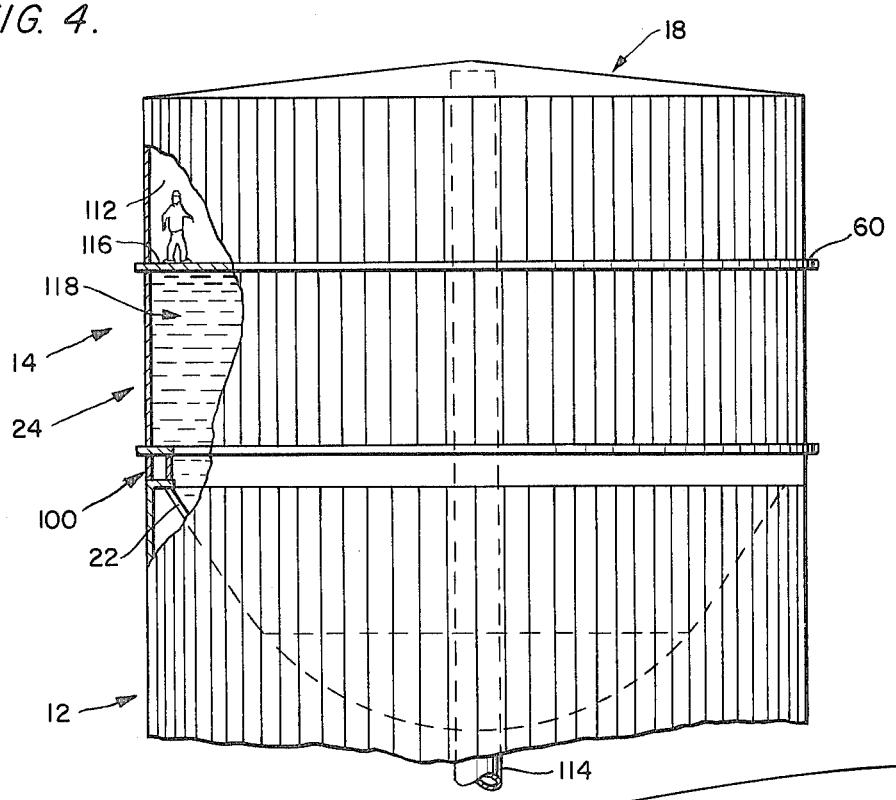
FIG. 4 is an elevation view of an alternative embodiment of an elevated water storage facility embodying the teachings of the present invention.

The FIG. 1 embodiment is shown in FIG. 4 with usable space 112 located in the roof portion of the tank along with a riser 114. Space 112 can be used for many purposes, such as, for example, a restaurant, or the like. The space of a pillar could be used for offices, parking, shops or the like, and a floor 116 can serve as the top of the water storage portion 118 of the tank 14. The floor 116 can be supported at or by the upper strengthening ring 60.

As this invention may be embodied in several forms without departing from the spirit or essential characteristics thereof, the present embodiment is, therefore, illustrative and not restrictive, since the scope of the invention is defined by the appended caims rather than by the description preceding them, and all changes that fall within the metes and bounds of the claims or that form their functional as well as conjointly cooperative equivalents are, therefore, intended to be embraced by those claims.

I claim:

1. An improvement in a multi-story elevated water storage facility comprising: an elevated water storage tank supported on a pillar and occupying substantially all of the top cross-sectional area of the pillar, means fluidly connected to the storage tank for distributing water from the tank to a user located outside the area immediately adjacent to the pillar, the facility having means associated with the pillar beneath the tank to define a building which is located in an elevated water storage tank structure so that a single structure serves as both an elevated water storage facility and a building, a multiplicity of flutes defined on the water storage tank to form a fluted portion of that tank, and connecting means connecting the fluted portion of the water tank to a bottom portion of the water tank.

2. The improvement defined in claim 1 wherein said connecting means connects the fluted portion of the water tank to the pillar.

3. The improvement defined in claim 1 wherein the pillar includes a plurality of flutes defined thereon.

4. The improvement defined in claim 2 wherein said connecting means includes a box girder.

5. The improvement defined in claim 1 further including means defining a floor above a water storage portion of the water tank.

6. The improvement defined in claim 1 further including a plurality of strengthening rings on the fluted portion of the water tank.

7. The improvement defined in claim 6 wherein one of said strengthening rings is located outside the tank.

8. The improvement defined in claim 6 wherein one of said strengthening rings is located inside the tank.

9. A method of erection of a multi-story elevated water storage facility comprising the following steps:

erecting a fluted support pillar;

erecting a bottom tank portion at the top of the fluted support pillar;

making sub-assemblies of fluted plates for a cylindrical wall portion of a water storage tank;

lifting said sub-assemblies after completion thereof into position on the upper end of the fluted support pillar;

fitting the joints between sub-assemblies together and affixing same together;

fitting strengthening structure to said sub-assemblies and affixing same securely together; and erecting a top structure over all of the aforesaid.

10. The method of claim 9, wherein the step of making sub-assemblies of fluted plates includes the additional step of fitting several or more fluted water tank wall plates together on the ground and the further step of welding them to a portion of a strengthening ring to form each sub-assembly.

11. The method of claim 10, wherein the strengthening ring of each sub-assembly after fitting of the water storage tank wall sub-assemblies together is secured together by welding to form an integral ring, and wherein said additional strengthening rings include at least three such rings with at least one of the rings being inside of the water storage tank and located at approximately one-third of the distance from the bottom thereof; and including the further steps of welding all of the fluted plates, strengthening rings and the top covering structure securely together so that a watertight storage facility is constructed in the minimum of building time.

12. A multi-story elevated water storage facility comprising: an elevated water storage tank supported on a pillar and occupying a substantial portion of the top cross-sectional area of the pillar, means fluidly connected to the storage tank for distributing water from the tank to a user located outside the area immediately adjacent to the pillar, the facility having means associated with the pillar beneath the tank to define a building which is located in an elevated water storage tank structure so that a single structure serves as both an elevated water storage facility and a building, said water storage tank being formed with a cylindrical portion from a plurality of plates each of which includes a flute, said pillar also including a plurality of flutes defined thereon, and connecting means for transferring loading vectors connecting the fluted cylindrical portion of the water storage tank to the top of the fluted portion of said pillar.

13. The water storage facility defined in claim 12 wherein said connecting means includes a box girder.

14. The water storage facility defined in claim 13 wherein said box girder also connects the fluted cylindrical portion of the water tank to a spherical bottom portion of the water tank.

15. The water storage facility defined in claim 14, further including a plurality of strengthening rings on the fluted cylindrical portion of the water tank for providing strength to said tank.

16. The water storage facility defined in claim 15 wherein at least one of said plurality of strengthening rings is located outside the tank.

17. The water storage facility defined in claim 15 wherein at least one of said plurality of strengthening rings is located inside the tank.

18. The water storage facility defined in claim 17 further including means defining a floor on top of a water storage portion of the water tank.

19. The water storage facility defined in claim 12 wherein said connecting means connects the fluted cylindrical portion of the water tank to a bottom portion of the water tank, and further means for resisting the loads induced by water in said storage tank are provided with said fluted cylindrical portion of the tank.

20. The water storage facility defined in claim 19 wherein said further means for resisting the loads induced by water in said storage tank includes a plurality of strengthening rings on the fluted cylindrical portion of the water tank, at least one of which is located outside the tank, and another of which is located inside of said tank at about one-third of the tank height.

* * * * *